US007497813B1

(12) United States Patent
Krull

(10) Patent No.: US 7,497,813 B1
(45) Date of Patent: Mar. 3, 2009

(54) METHODS FOR ADJUSTING WEIGHT RESISTANCE TO EXERCISE

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 210 days.

(21) Appl. No.: 11/476,988

(22) Filed: Jun. 27, 2006

Related U.S. Application Data

(63) Continuation of application No. 10/270,787, filed on Oct. 11, 2002, now Pat. No. 7,066,867.

(51) Int. Cl.
*A63B 21/075* (2006.01)

(52) U.S. Cl. ..... 482/107; 482/108

(58) Field of Classification Search ..... 482/92–94, 482/98, 99, 106–109
See application file for complete search history.

(56) References Cited

U.S. PATENT DOCUMENTS 4,538,805 A * 9/1985 Parviainen ..... 482/98
5,284,463 A * 2/1994 Shields ..... 482/107
7,060,011 B1 * 6/2006 Krull ..... 482/107
7,066,867 B2 * 6/2006 Krull ..... 482/108
7,335,139 B2 * 2/2008 Bartholomew et al. ..... 482/97
7,387,597 B2 * 6/2008 Krull ..... 482/108

FOREIGN PATENT DOCUMENTS

JP 10118222 A * 5/1998

* cited by examiner

*Primary Examiner*—Loan H Thanh
*Assistant Examiner*—Victor K Hwang

(57) ABSTRACT

An exercise dumbbell includes a handle member and weight plates maintained in spaced relationship at opposite ends thereof. Weight selectors are movable into and out of engagement with different combinations of the weight plates to secure a desired amount of mass to the handle. The weight selectors are preferably nested within respective ends of the handle member and accessible via upwardly opening slots in the weight plates.

11 Claims, 14 Drawing Sheets

METHODS FOR ADJUSTING WEIGHT RESISTANCE TO EXERCISE

CROSS-REFERENCE TO RELATED APPLICATIONS

This is a continuation of U.S. patent application Ser. No. 10/270,787, filed Oct. 11, 2002 (now U.S. Pat. No. 7,066, 867).

FIELD OF THE INVENTION

The present invention relates to exercise equipment and more particularly, to methods and apparatus for adjusting weight on weight lifting apparatus, including free weights.

BACKGROUND OF THE INVENTION

Past efforts have led to various inventions directed toward adjustable weight exercise devices. Some examples of such efforts in the field of free weights are disclosed in U.S. Pat. No. 4,284,463 to Shields; U.S. Pat. No. 4,529,198 to Hettick, Jr.; U.S. Pat. No. 4,822,034 to Shields; U.S. Pat. No. 5,769, 762 to Towley, III et al.; U.S. Pat. No. 5,839,997 to Roth et al.; U.S. Pat. No. 6,099,442 to Krull; U.S. Pat. No. 6,033,350 to Krull; and U.S. Pat. No. 6,322,481 to Krull. Despite these advances and others in the field of weight lifting equipment, room for continued improvement remains. Accordingly, an object of the present invention is to provide new and advantageous apparatus and/or methods for selecting different combinations of weight to resist exercise movement.

SUMMARY OF THE INVENTION

The present invention provides methods and apparatus involving the movement of mass subject to gravitational force. In a preferred application, the present invention allows a person to adjust weight resistance by securing desired amounts of mass to opposite ends of a handlebar or other weight lifting member.

The present invention may be described in terms of exercise dumbbells. One such dumbbell comprises a handle member having a first weight supporting section, a second weight supporting section, and a handle that extends therebetween and defines a longitudinal axis, wherein each said weight supporting section has an axially measured length that is bounded by a respective inner end and a respective outer end; first weights sized and configured to be supported by the first weight supporting section; second weights sized and configured to be supported by the second weight supporting section; and a first weight selector associated with the first weight supporting section and the first weights, and a second weight selector associated with the second weight supporting section and the second weights, wherein each said weight selector is movably mounted on the handle assembly and movable between a respective first latched position, disposed entirely outboard from a respective inner end, and a respective second latched position, disposed entirely inboard from a respective outer end, displaced axially relative to a respective first latched position, and engaging a different combination of respective weights.

Another such dumbbell comprises a handle member having a first weight supporting section, a second weight supporting section, and a handle that extends therebetween and defines a longitudinal axis, wherein each said weight supporting section includes an axially extending bar; first weights sized and configured to be supported by the first weight supporting section, wherein each of the first weights has an upwardly opening slot that accommodates a respective said bar; second weights sized and configured to be supported by the second weight supporting section, wherein each of the second weights has an upwardly opening slot that accommodates a respective said bar; a first weight selector and a second weight selector, wherein each said weight selector is movably mounted on a respective end of the handle member, and is configured to selectively engage at least one of the weights associated therewith; and a first operator member and a second operator member, wherein each said operator member is connected to a respective weight selector and extends upward through at least one said slot in the weights associated therewith.

Yet another such exercise dumbbell comprises a handle member having a handle that defines a longitudinal axis, and axially spaced weight supports disposed at opposite ends of the handle; first weight plates sized and configured to be supported by respective weight supports at a first end of the handle member, including an innermost first weight plate having an innermost surface that faces toward the handle, and an outermost first weight plate having an outermost surface that faces away from the handle; a first weight selector movably mounted on the handle member and movable axially to a position disposed entirely between the innermost surface on the innermost first weight plate and the outermost surface on the outermost first weight plate, and underlying at least one of the first weight plates but less than all of the first weight plates; second weight plates sized and configured to be supported by respective weight supports at a second end of the handle member, including an innermost second weight plate having an innermost surface that faces toward the handle, and an outermost second weight plate having an outermost surface that faces away from the handle; and a second weight selector movably mounted on the handle member and movable axially to a position disposed entirely between the innermost surface on the innermost second weight plate and the outermost surface on the outermost second weight plate, and underlying at least one of the second weight plates but less than all of the second weight plates.

Still another such dumbbell comprises a handle member having a first weight supporting section, a second weight supporting section, and a handle that extends therebetween and defines a longitudinal axis; first weights sized and configured to be supported by the first weight supporting section; a first weight selector confined to the first weight supporting section and selectively movable in a first direction to engage only a first subset of the first weights; a second weight selector confined to the first weight supporting section and selectively movable in an opposite, second direction to engage only a second, complementary subset of the first weights; second weights sized and configured to be supported by the second weight supporting section; a third weight selector confined to the second weight supporting section and selectively movable in said first direction to engage only a first subset of the second weights; and a fourth weight selector confined to the second weight supporting section and selectively movable in said second direction to engage only a second, complementary subset of the second weights.

The present invention may also be described with reference to a method of adjusting weight on a selectorized dumbbell. One such method comprises providing a handle member having a handle that defines a longitudinal axis, first and second weight supporting sections at opposite ends of the handle, first and second bars that extend through respective weight supporting sections, and weight selectors that are movable axially along respective weight supporting sections; and providing first end weights and second end weights that are configured to be supported in respective, axially spaced positions defined by the respective weight supporting sections, and to be selectively engaged by respective weight selectors, and that have slots to accommodate insertion of respective bars and to provide operational access to respective weight selectors.

Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts throughout the several views.

FIG. 31 is a top view of a weight selector on the dumbbell of FIGS. 29-30;

DETAILED DESCRIPTION OF A PREFERRED EMBODIMENT

Figure 1:
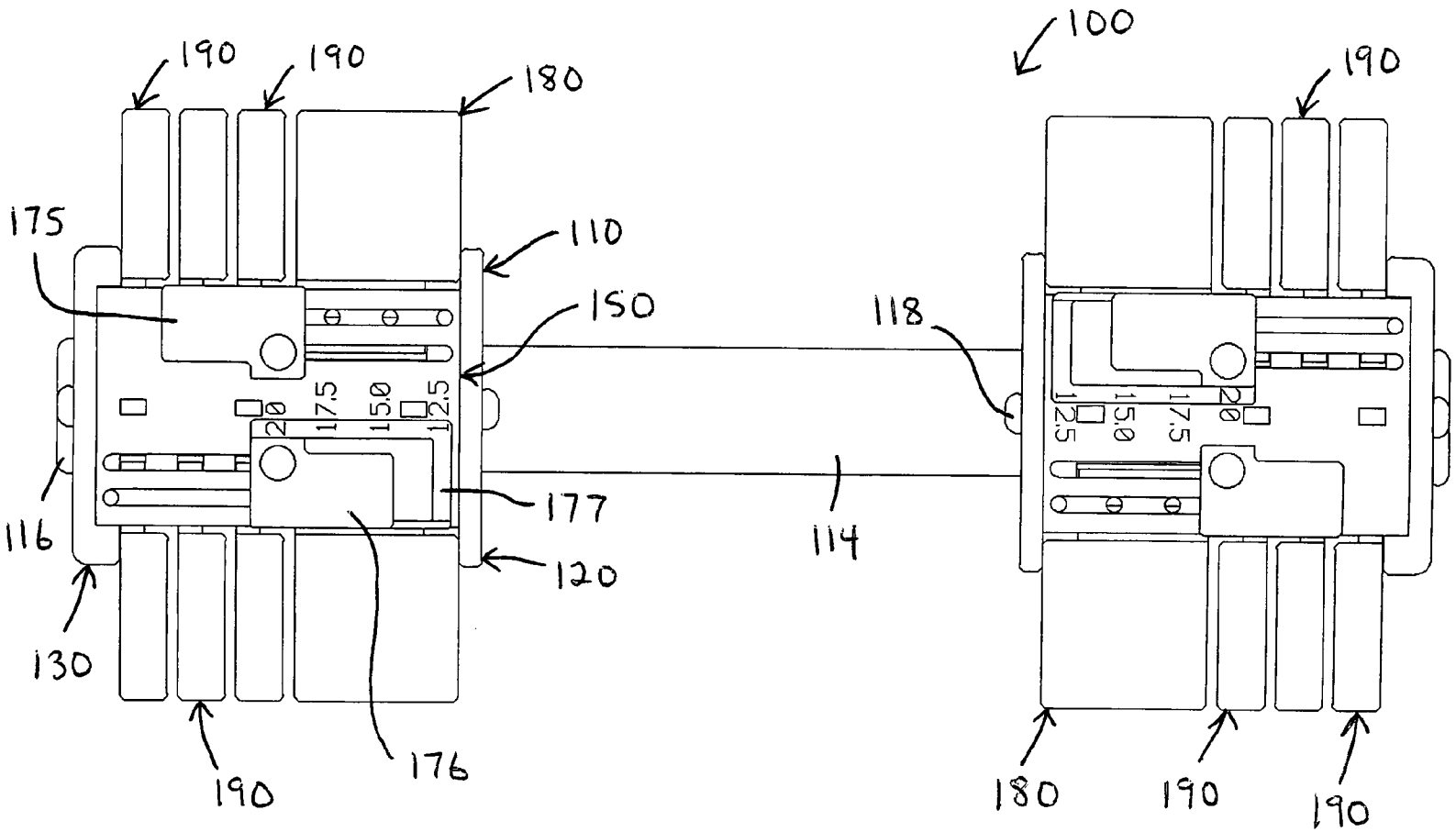
FIG. 1 is a top view of an exercise dumbbell constructed according to the principles of the present invention.

FIGS. 1-4 show an exercise dumbbell constructed according to the principles of the present invention and designated as 100. The dumbbell 100 includes a weight lifting member or handle member 110, and a plurality of weight plates 180 and 190 that are selectively secured to the handle assembly 110. In a manner already known in the art (and further described below with reference to an alternative embodiment), the weight plates 180 and 190 are preferably supported by a base or cradle when not in use. Also, some other suitable weight supporting bases are disclosed in the patents identified in the Background of the Invention, which are incorporated herein by reference.

The handle member 110 includes a bar 112 (shown in FIG. 4) that preferably has a square profile and is made of steel. The bar 112 extends substantially the entire length of the handle member 110. A hand grip 114 is mounted on an intermediate portion of the bar 112. The hand grip 114 is preferably a plastic tube having a generally cylindrical outer surface that may be knurled and/or contoured to facilitate a comfortable and reliable grip. A square bore extends through the hand grip 114 to facilitate a snug fit on the bar 112 and prevent rotation relative thereto. The hand grip 114 and/or the bar 112 define a longitudinal axis, and the term "axially" is used herein to describe a direction parallel to this axis (not necessarily along the axis itself). Also, the terms "transversely" and "laterally" are used herein to describe a direction perpendicular to this axis (not necessarily in a common plane or intersecting the axis).

Figure 5:
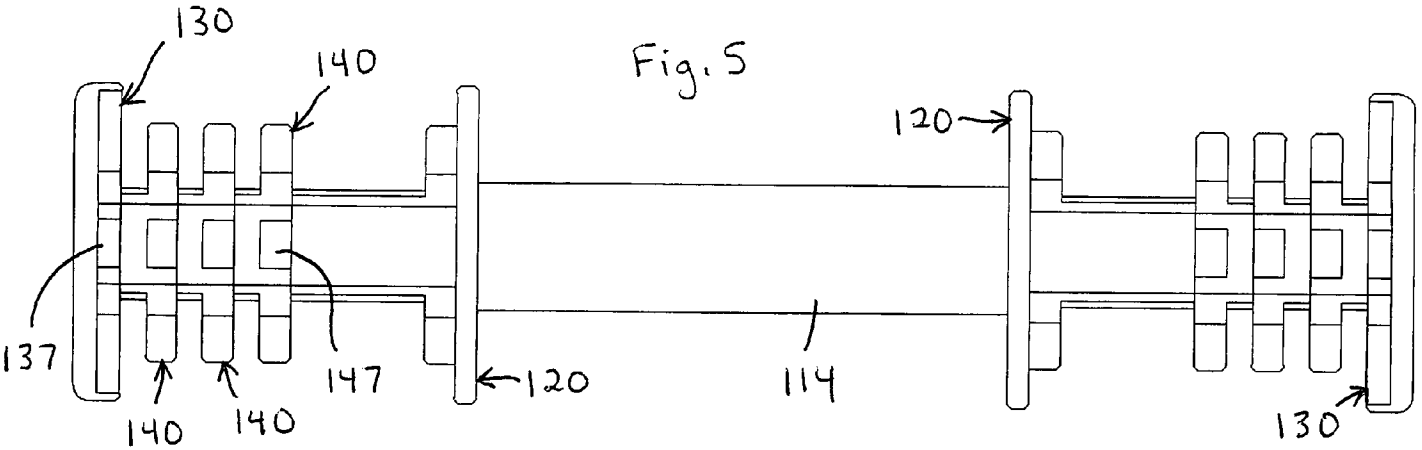
FIG. 5 is a top view of certain handle member components on the dumbbell of FIG. 1.
Figure 6:
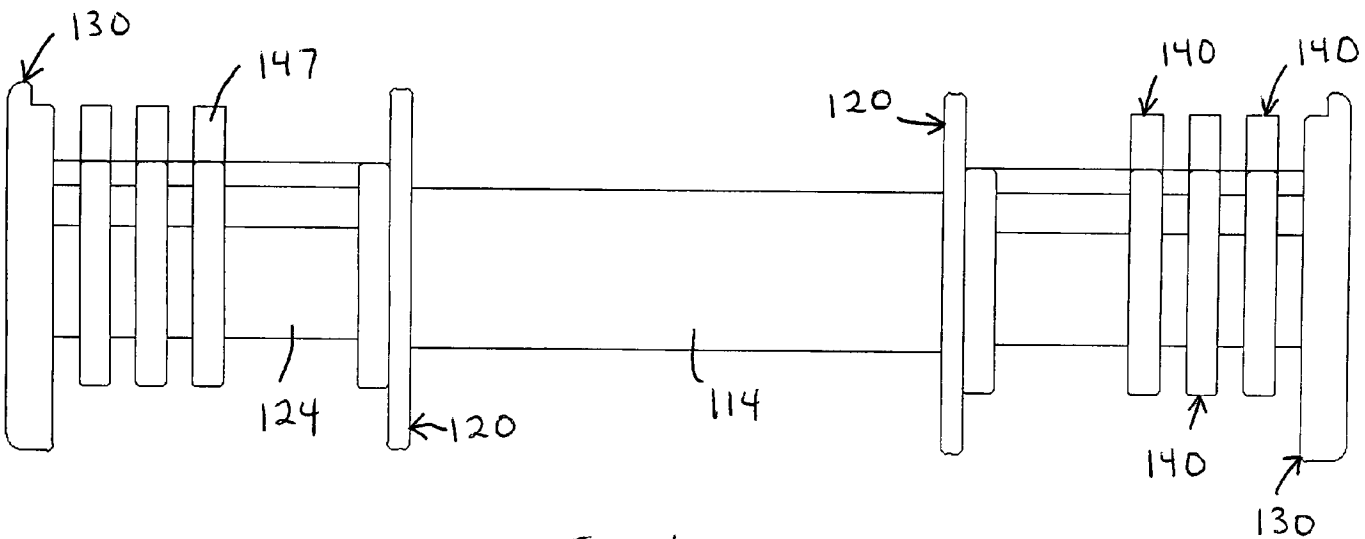
FIG. 6 is a side view of the handle member components of FIG. 5.

First and second sets of weight supports or spacers 120, 130, and 140 are mounted on respective ends of the bar 112 to define respective weight supporting sections. The supports 120, 130, and 140 are preferably injection molded plastic parts. FIGS. 5-6 shows how the supports 120, 130, and 140, as well as the hand grip 114, are arranged on the bar 112. Each weight supporting section may be described as having an axially measured length that is measured between an innermost surface on a respective innermost support 120 (shown in FIG. 8), and an outermost surface on a respective outermost support 130 (shown in FIG. 10). The terms "innermost" and "outermost" are made with reference to the hand grip 114, so that "innermost" means closest to the hand grip 114, and "outermost" means furthest from the hand grip 114. The innermost surface on the innermost support 120 faces toward the hand grip 114, and the outermost surface on the outermost support 130 faces away from the hand grip 114, and the intermediate supports 140 are outboard of respective innermost supports 120, and inboard of respective outermost supports 130. The term "outboard" is intended to mean relatively further from the hand grip, and the term "inboard" is intended to mean relatively closer to the hand grip.

Figure 7:
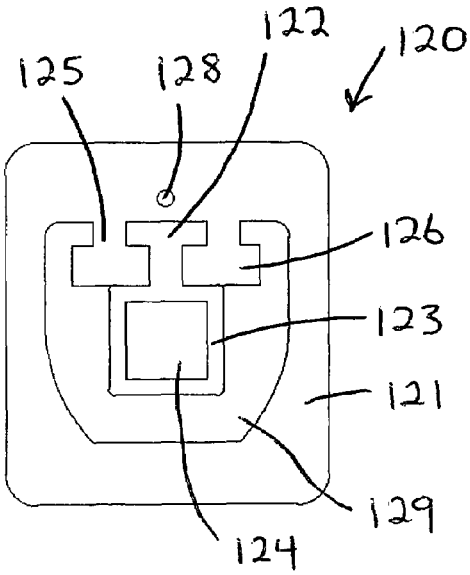
FIG. 7 is an end view of an innermost weight support that is among the components shown in FIGS. 5-6.
Figure 8:
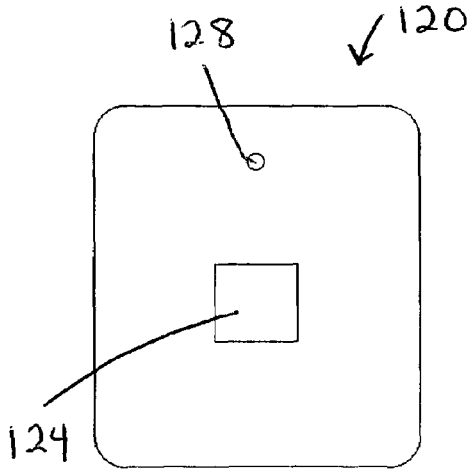
FIG. 8 is an opposite end view of the weight support of FIG. 7.

One of the innermost supports 120 is shown by itself in FIGS. 7-8. The support 120 includes a plate portion 121 that is flat and bounded by a generally rectangular perimeter. A first offset protrudes axially beyond an outboard side of the plate 121, and includes a T-shaped portion 122 and a square tube portion 123. A square hole 124 extends through the square tube portion 123 and an axially adjacent portion of the plate 121 to accommodate a snug fit on the bar 112 and prevent rotation relative thereto. A second, less pronounced offset 129 protrudes axially beyond the same outboard side of the plate 121 and surrounds most of the first offset. The second offset 129 cooperates with portions of the first offset to define laterally adjacent, first and second channels 125 and 126. A hole 128 extends axially through the plate 121 at a location above the T-shaped portion 122.

Figure 9:
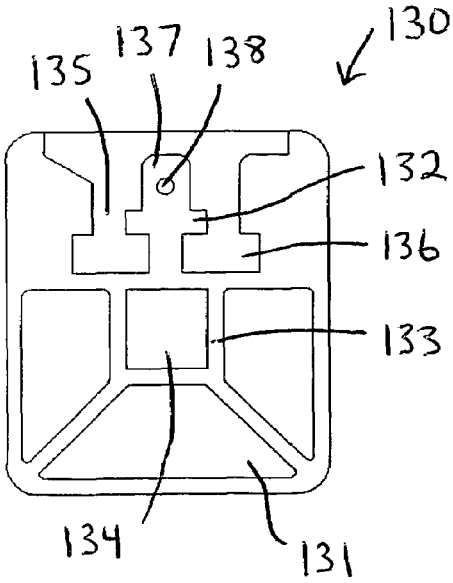
FIG. 9 is an end view of an outermost weight support that is among the components shown in FIGS. 5-6.
Figure 10:
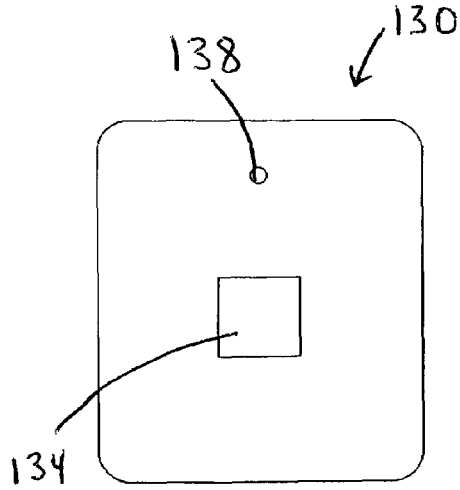
FIG. 10 is an opposite end view of the weight support of FIG. 9.
Figure 12:
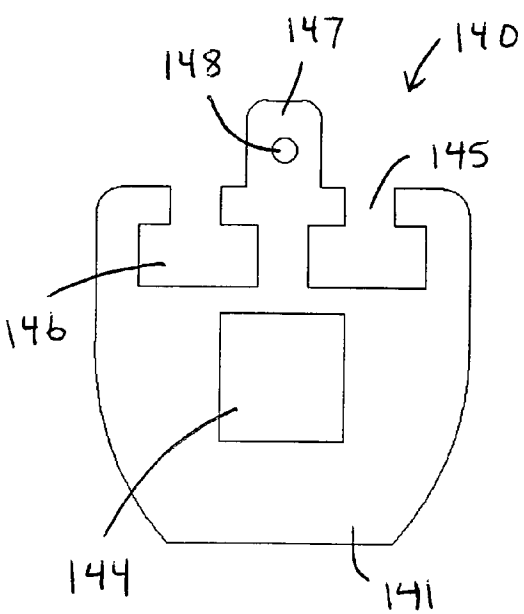
FIG. 12 is an end view of the weight support of FIG. 11.
Figure 11:
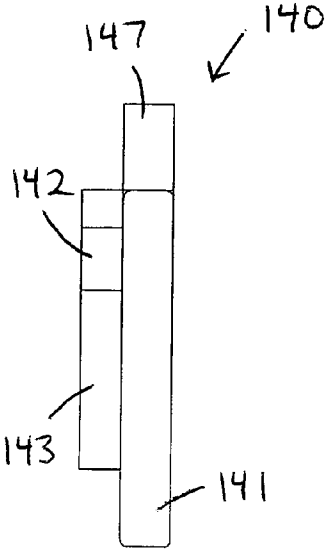
FIG. 11 is a side view of an intermediate weight support that is among the components shown in FIGS. 5-6.
Figure 13:
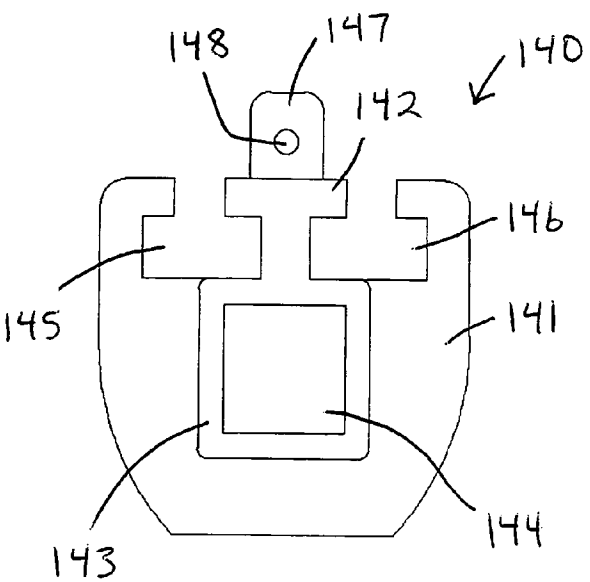
FIG. 13 is an opposite end view of the weight support of FIG. 11.
Figure 14:
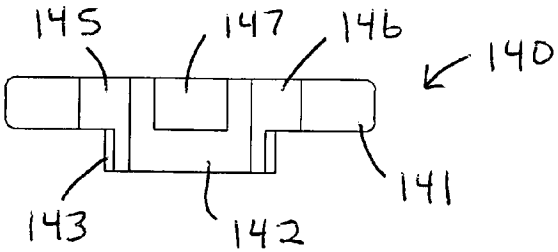
FIG. 14 is a top view of the weight support of FIG. 13.
Figure 17:
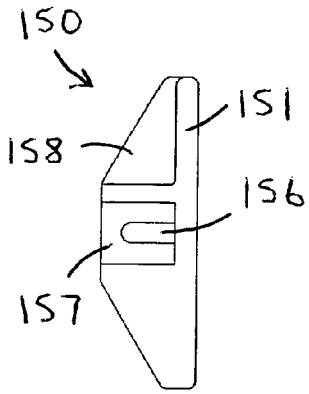
FIG. 17 is an end view of the component of FIG. 16.
Figure 16:
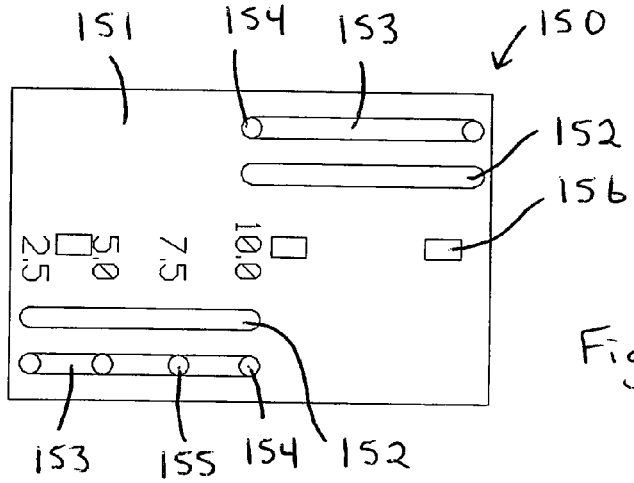
FIG. 16 is a top view of the component of FIG. 15.

One of the outermost supports 130 is shown by itself in FIGS. 9-10. The support 130 includes a plate portion 131 that is flat and bounded by a generally rectangular perimeter. A single offset protrudes axially beyond an inboard side of the plate 131, and includes a T-shaped portion 132 and a square tube portion 133 similar in configuration to counterparts 122 and 123 on the innermost support 120. Also, a square hole 134 similarly extends through the square tube portion 133 and an axially adjacent portion of the plate 131 to accommodate a snug fit on the bar 112 and prevent rotation relative thereto. The offset also includes additional portions that cooperate with the portions 132 and 133 to define adjacent, first and second channels 135 and 136 similar in configuration and position to the channels 125 and 126 on the innermost support 120. The offset also includes a nub 137 that projects upward from the T-shaped portion 132. A hole 138 extends axially through the nub 137 and an axially adjacent portion of the plate 131, and aligns with the hole 128 in the innermost support 120 when the parts are arranged on the bar 112.

One of the intermediate supports 140 is shown by itself in FIGS. 11-14. The support 140 includes a plate portion 141 that is flat and bounded by a perimeter similar to the generally crown-shaped offset 129 on the innermost plates 120. A single offset protrudes axially beyond an outboard side of the plate 141, and includes a T-shaped portion 142 and a square tube portion 143. A square hole 144 extends through the square tube portion 143 and an axially adjacent portion of the plate 141 to accommodate a snug fit on the bar 112 and prevent rotation relative thereto. The offset portions 142 and 143 cooperate with portions of the plate 141 to define adjacent, first and second channels 145 and 146 similar in configuration and position to the channels 125 and 126 on the innermost support 120. The plate 141 also includes a nub 147 that projects upward from the T-shaped portion 142. A hole 148 extends axially through the nub 147 and aligns with the hole 128 in the innermost support 120 when the parts are arranged on the bar 112.

Figure 2:
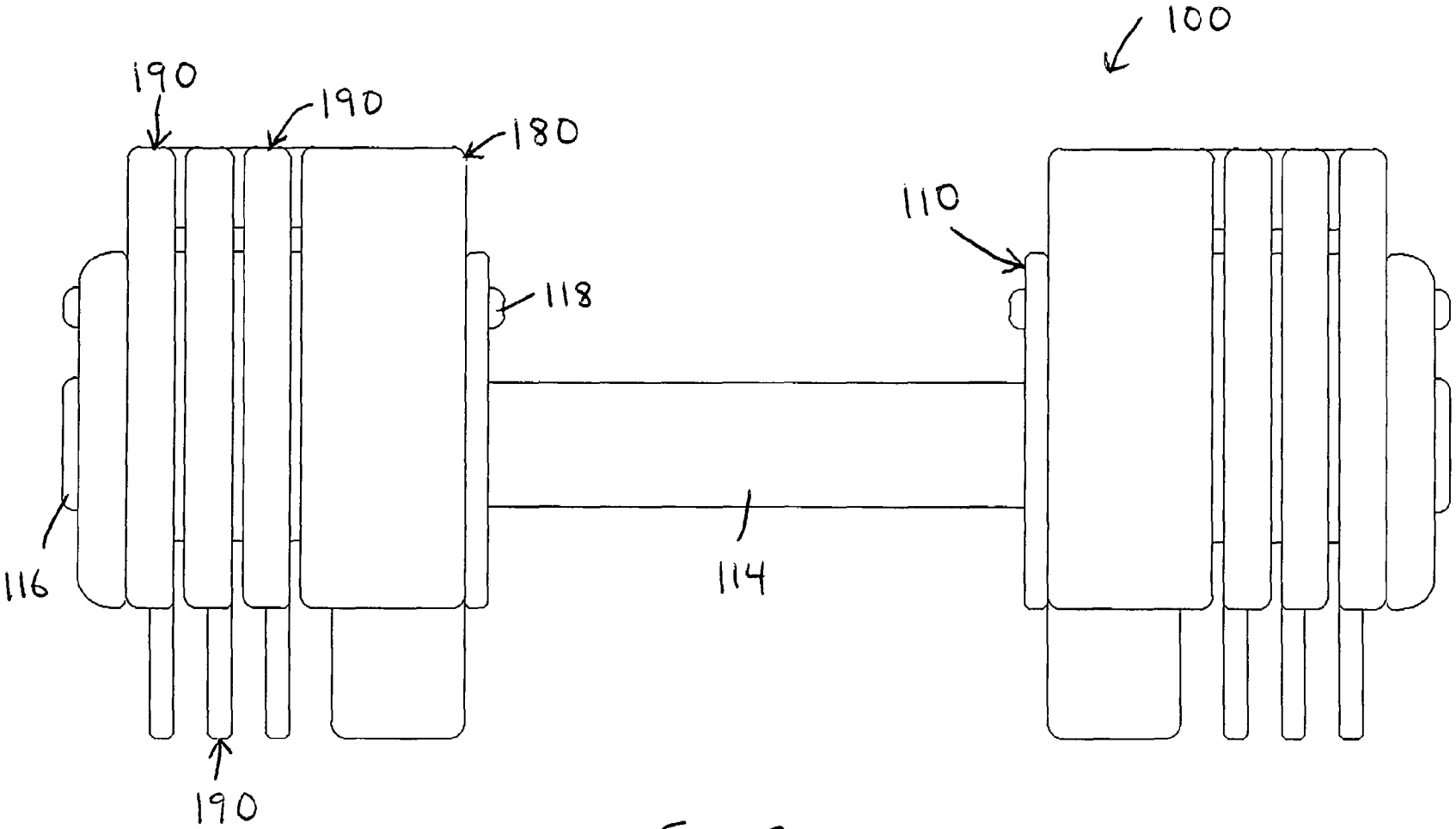
FIG. 2 is a side view of the dumbbell of FIG. 1.
Figure 3:
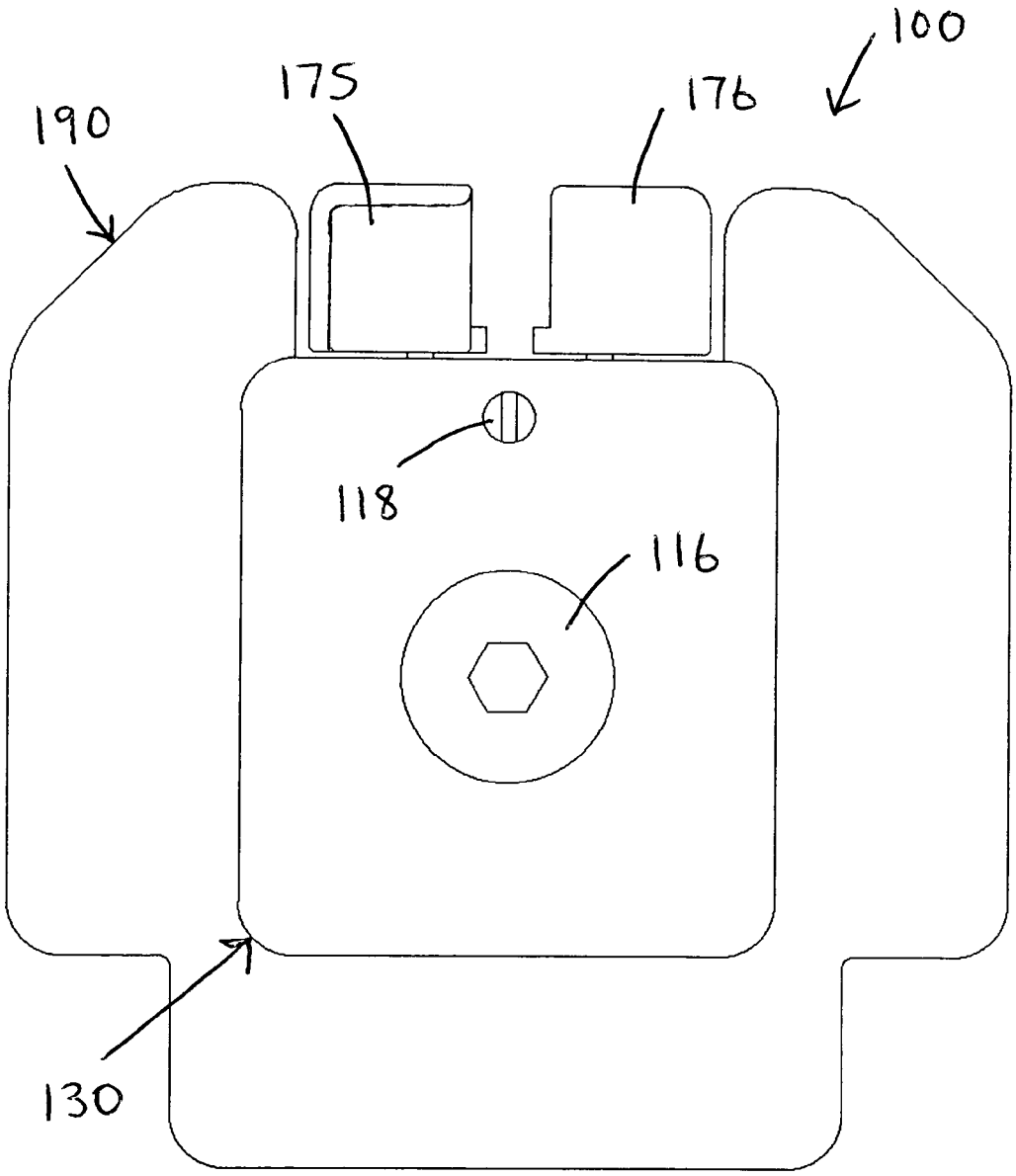
FIG. 3 is an end view of the dumbbell of FIG. 1.

As shown in FIGS. 1-3, first and second end fasteners 116 are secured to respective ends of the bar 112, preferably in a manner that clamps the supports 120, 130, and 140 and the hand grip 114 therebetween. Each fastener 116 is preferably a bolt having a shaft that threads into a respective end of the bar 112, and a relatively large diameter head that overlies a respective outermost support 130.

Figure 4:
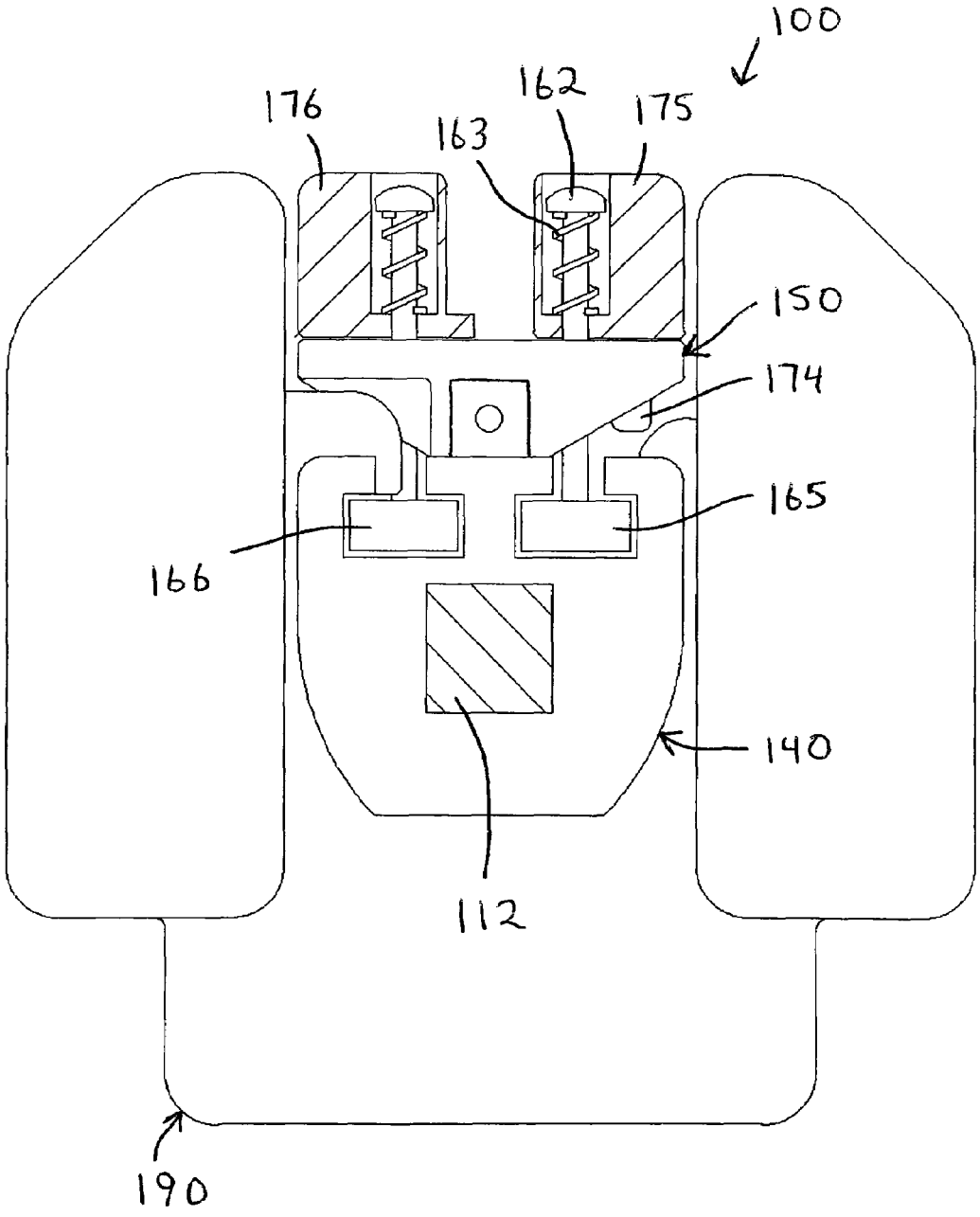
FIG. 4 is a partially sectioned end view of the dumbbell of FIG. 1.

FIG. 4 is a partially sectioned end view of the dumbbell 100, with the inboard side of an intermediate support 140 exposed and in view. At each end of the handle member 110, the channels 125, 135, and 145 align with one another to define a first, axially extending, weight selector channel that accommodates a first bar 165, and the channels 126, 136, and 146 align with one another to define a second, axially extending, weight selector channel that accommodates a second bar 166. Each bar 165 and 166 is preferably made of steel and provided with a threaded hole to receive a respective bolt 162. The supports 120, 130, and 140 are configured with slots above their respective channels to accommodate axial travel of respective bolts 162.

Each bolt 162 is inserted through three intermediate components before being threaded into a respective bar 165 or 166. The first of the intermediate components is a helical coil spring 163 having an inside diameter that is greater than the diameter of the shaft portion of a bolt 162, and less than the diameter of the head portion of a bolt 162. The second of the intermediate components is a push button or operator member. A first operator member 175 is associated with the first bar 165, and a second, discrete operator member 176 is associated with the second bar 166.

Figure 20:
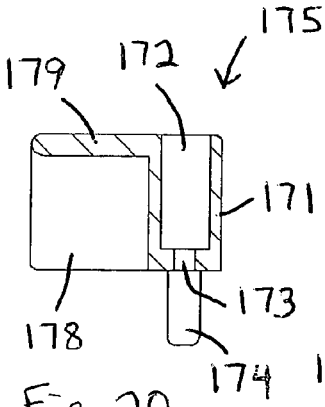
FIG. 20 is a sectioned end view of another handle member component that is not shown in FIGS. 5-6.
Figure 15:
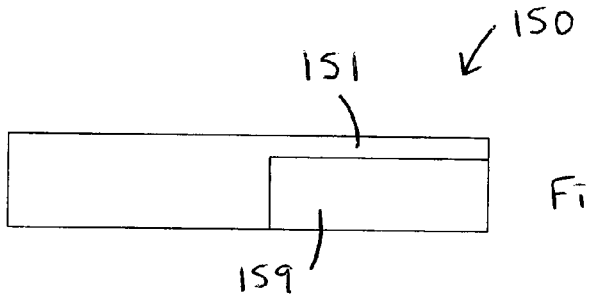
FIG. 15 is a side view of a handle member component that is not shown in FIGS. 5-6.
Figure 18:
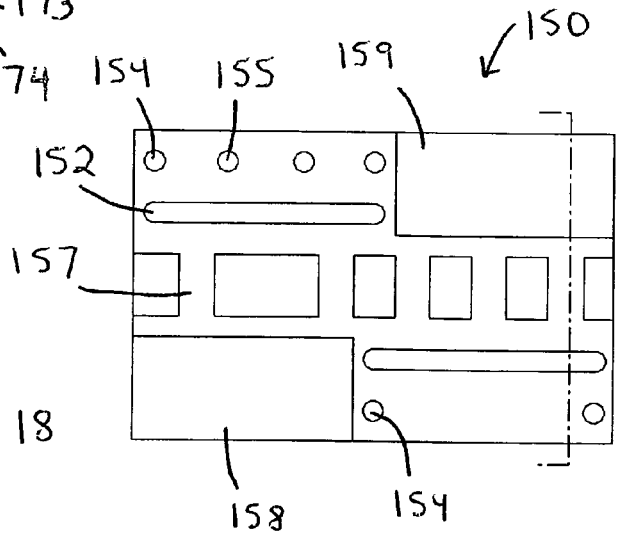
FIG. 18 is a bottom view of the component of FIG. 15.
Figure 19:
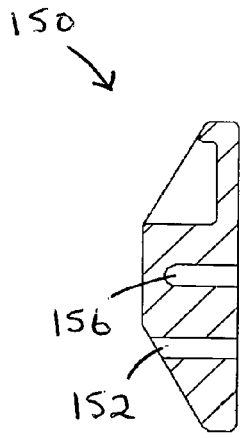
FIG. 19 is a sectioned end view of the component of FIG. 18.
Figures 21, 22, 23, 24:
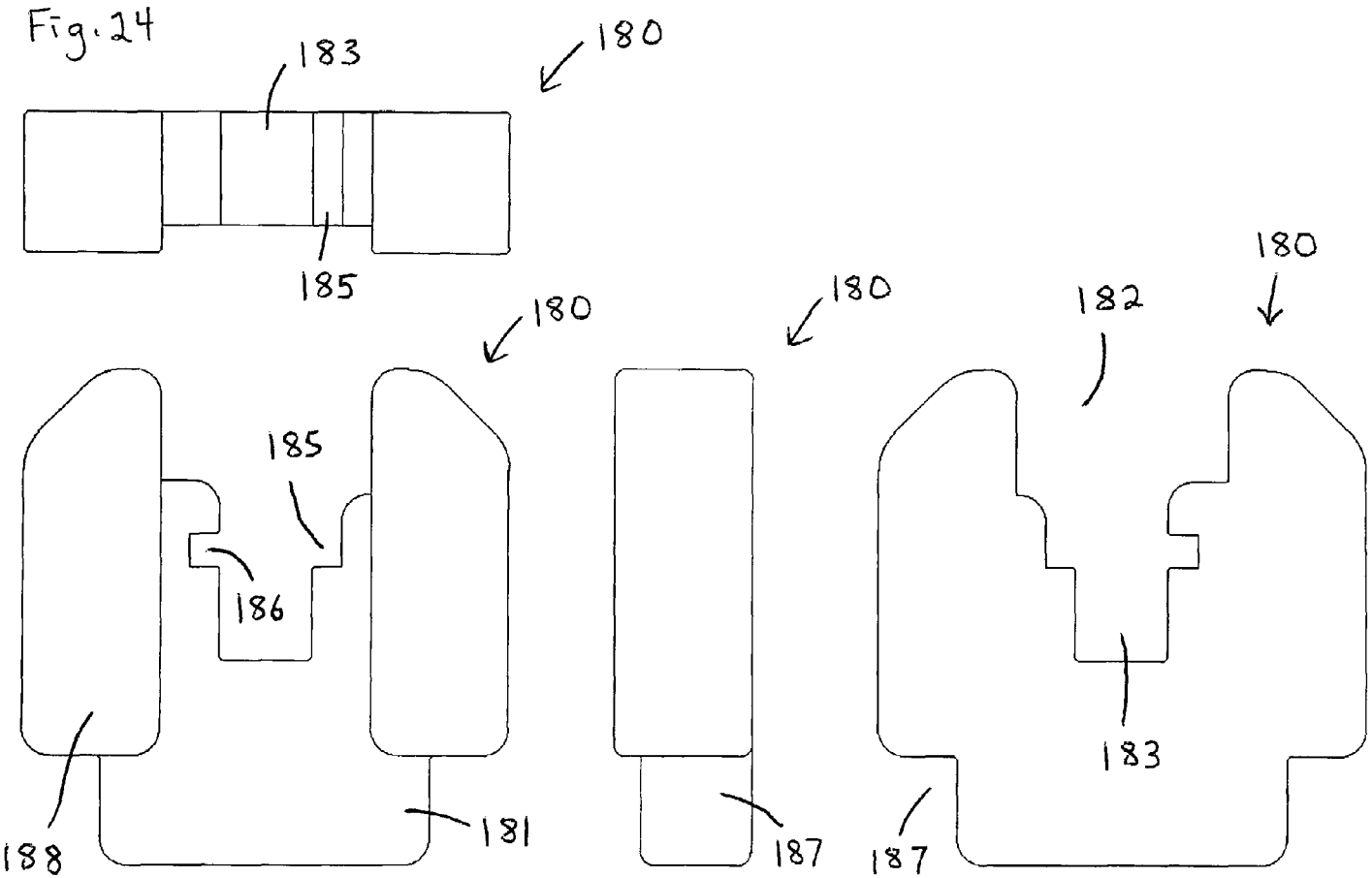
FIG. 21 is a side view of a first weight plate on the exercise dumbbell of FIG. 1.
FIG. 22 is an end view of the weight plate of FIG. 21.
FIG. 23 is an opposite end view of the weight plate of FIG. 21.
FIG. 24 is a top view of the weight plate of FIG. 21.
Figures 25, 26, 27, 28:
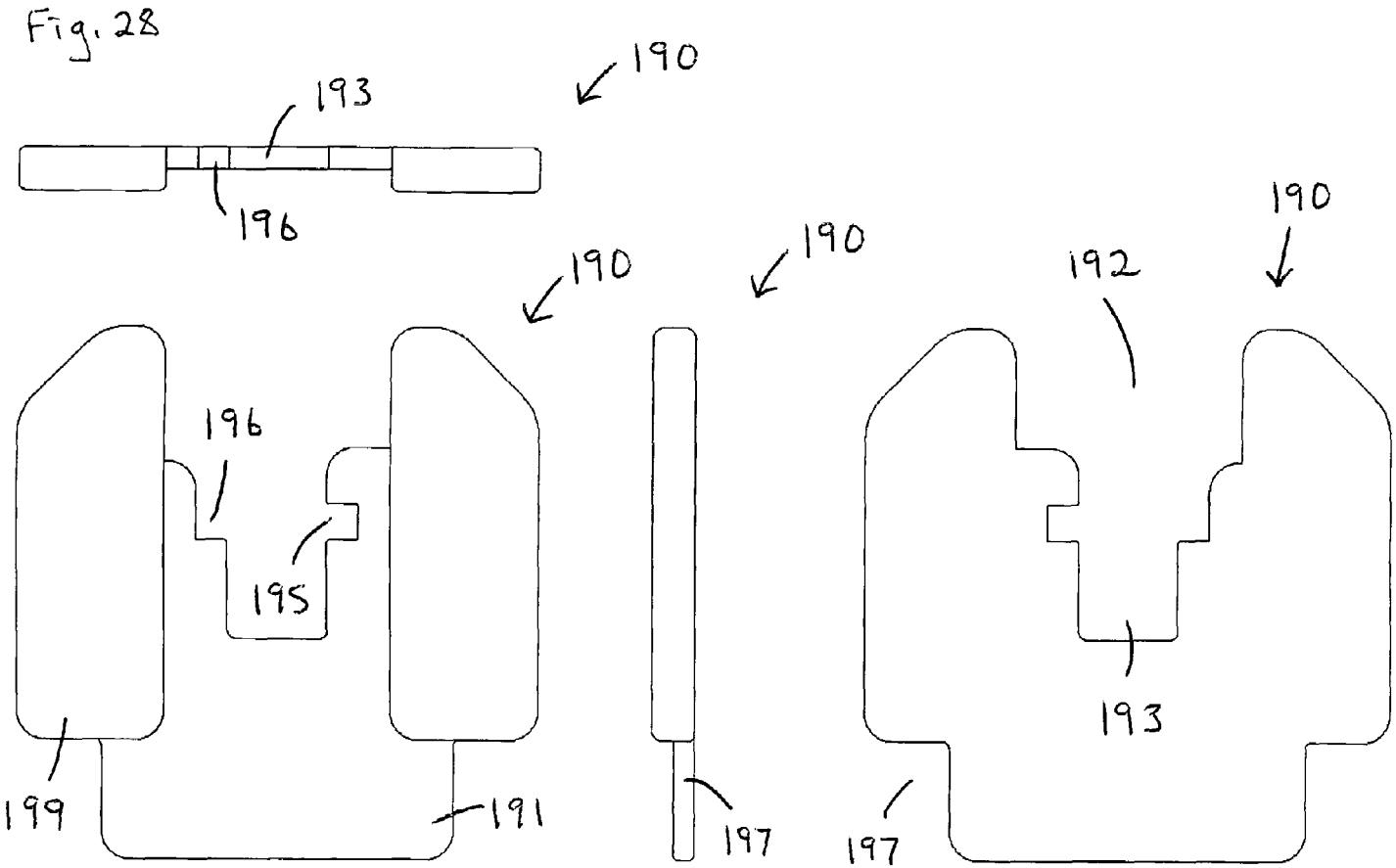
FIG. 25 is a side view of a second weight plate on the exercise dumbbell of FIG. 1.
FIG. 26 is an end view of the weight plate of FIG. 25.
FIG. 27 is an opposite end view of the weight plate of FIG. 25.
FIG. 28 is a top view of the weight plate of FIG. 27.

One of the operator members 175 is shown by itself in FIG. 20. Each of the operator members 175 and 176 includes a closed end portion 171 that surrounds both an upwardly opening bore 172 and an aligned, downwardly opening bore 173. The upwardly opening bore 172 is large enough in diameter to accommodate both a spring 163 and the head portion of a bolt 162, and the downwardly opening bore 173 is large enough in diameter to accommodate the shaft portion of a bolt 162 (but not a spring 163 nor the head portion of a bolt 162). Each of the operator members 175 and 176 also includes a sidewall 178 and a top wall 179 that cooperate with the closed end portion to define a cavity to accommodate a person's fingertip. Unlike the operator members 175, each operator member 176 also includes an L-shaped strip 177 (see FIG. 1) that is disposed outside the planform of the top wall 179, and extends between the end portion 171 and the side wall 178.

The third of the intermediate components (disposed between the head portion of a respective bolt 162 and a respective bar 165 or 166) is a top plate 150 that is preferably an injection molded plastic part. One of the top plates 150 is shown by itself in FIGS. 15-19. The top plate 150 has a top or uppermost wall 151 that is configured to extend between a respective innermost support 120 and a respective outermost support 130. First and second slots 152 extend through respective portions of the top wall 151 to accommodate insertion of respective bolts 162, as well as axial travel of said bolts 162. For reasons discussed below, discrete grooves 153 extend into the top wall 151 adjacent respective slots 152. At each end of each groove 153, a hole 154 extends downward from the bottom of the groove 153 and through the remainder of the top wall 151. Also, at intermediate points along the inboard groove 153, additional holes 155 extend downward from the bottom of the groove 153 and through the remainder of the top wall 151.

Along the center of the top wall 151, ribs 157 extend downward from the top wall 151 and cooperate with adjacent structure to define cavities therebetween. Notches 156 extend downward through the top wall 151 and into respective ribs 157. Discrete cavities between the ribs 157 are positioned to align with respective tabs 147 and a respective tab 137 during assembly of the dumbbell 100. Also, the notches 156 in the ribs 157 align with the holes 148 and 138 in the tabs 140 and 130, respectively, as well as the hole 128 in the end support 120, to receive the shaft of a bolt 118 (see FIGS. 1-3). Also, diagonally opposed openings 158 and 159 are located beneath the top wall 151 and opposite a respective slot 152 and a respective groove 153.

As shown in FIGS. 5-6, the supports 120, 130, and 140 cooperate to define weight receiving gaps therebetween. In particular, at each end of the handle member 110, the three outermost gaps are configured to receive respective lighter weight plates 190, and the innermost gap is configured to receive a relatively heavier weight plate 180.

One of the heavier weight plates 180 is shown by itself in FIGS. 21-24. The weight plate 180 includes a main body 181 having an axially measured thickness, and opposite side shoulders 188 that project axially outward from the inboard side of the main body 181. Opposite side notches 187 are provided in the lower corners of the main body 181. An upwardly opening slot 183 extends axially through the approximate center of the main body 181, and opens upward into a relatively larger gap 182 that extends axially through the upper portion of the main body 181. The slot 183 is configured to accommodate the square offset portion 123 on a respective innermost support 120, and the gap 182 is configured to accommodate the top plate 150, among other things. An upwardly opening notch 185 extends axially through the main body 181 between the slot 183 and the gap 182, and opens upward into the central gap 182. The notch 185 is configured to accommodate the bar 165 without being latched against downward movement relative thereto. A laterally opening notch 186 extends axially through the main body 181 between the slot 183 and the gap 182, and opens laterally toward the notch 185. The notch 186 is configured to receive the bar 166 and be latched against downward movement relative thereto.

One of the lighter weight plates 190 is shown by itself in FIGS. 25-28. The weight plate 190 includes a main body 191 having an axially measured thickness, and opposite side shoulders 199 that project axially outward from the inboard side of the main body 191. Opposite side notches 197 are provided in the lower corners of the main body 191. An upwardly opening slot 193 extends axially through the approximate center of the main body 191, and opens upward into a relatively larger gap 192 that extends axially through the upper portion of the main body 191. The slot 193 is configured to accommodate the square offset portion 143 on a respective intermediate support 130, and the gap 192 is configured to accommodate the top plate 150, among other things. An upwardly opening notch 196 extends axially through the main body 191 between the slot 193 and the gap 192, and opens upward into the central gap 192. The notch 196 is configured to accommodate the bar 165 without being latched against downward movement relative thereto. A laterally opening notch 195 extends axially through the main body 191 between the slot 193 and the gap 192, and opens laterally toward the notch 196. The notch 195 is configured to receive the bar 166 and be latched against downward movement relative thereto.

FIG. 1 shows the dumbbell 100 in its fully loaded configuration, with all of the available weight plates 180 and 190 secured thereto. In this configuration, each operator 176 occupies an inboard position, and each operator 175 occupies an outermost position. At each end of the dumbbell 100, the strip 177 on the operator 176 overlies the "tens" position of the numbers on the top plate 150, indicating that the available balanced weight amounts are 12.5 pounds, 15 pounds, 17.5 pounds, and 20 pounds, so long as the heavier weight plates 180 remain engaged. If the "heavy-weight" operator 176 is moved to an outboard position, then the "tens" position of the numbers on the top plate 150 will be revealed, indicating that the available balanced weight amounts have changed to 2.5 pounds, 5 pounds, 7.5 pounds, and 10 pounds. Each operator 176, as well as each operator 175, is relocated by first pulling upward against the bias of a respective spring 163 (to release the associated peg 174 for movement), and then sliding axially to a desired position, and then allowing the peg 174 to return downward into a respective hole in a respective top plate 150. The peg 174 remains in a respective groove 152 throughout the process to maintain the operator in a fixed orientation.

Regardless of the position of the heavy-weight operator 176, the closed end portion 171 of the light-weight operator 175 always aligns with the correct indicator of how much weight is selected (assuming that the two operators 176 occupy like positions, and the two operators 175 occupy like positions). For example, if the operators 175 shown in FIG. 1 are moved inboard one increment (so respective pegs 174 occupy respective outboard holes 155, rather than outermost holes 154), then the outermost plates 190 will be released, and the closed end portions 171 will correctly indicate that the dumbbell 100 has been adjusted to weigh 17.5 pounds. The dumbbell 100 may also be adjusted to provide seven slightly out of balance exercise loads. For example, if only one of the operators 175 is moved inboard one increment, then that end of the dumbbell 100 is set for a cumulative weight of 17.5 pounds, and the other end remains set for a cumulative weight of 20 pounds. The resulting load is the average of the two amounts, namely, 18.75 pounds.

An advantage of the dumbbell 100 is that only two different types of weight plates and eight total weight plates are required on each side of the dumbbell to provide eight different, balanced dumbbell loads, and seven additional, somewhat out of balance loads. The dumbbell is also relatively compact and easy to use. Moreover, the design may be readily adapted to provide a whole line of dumbbells that offer a variety of weight ranges.

Figure 29:
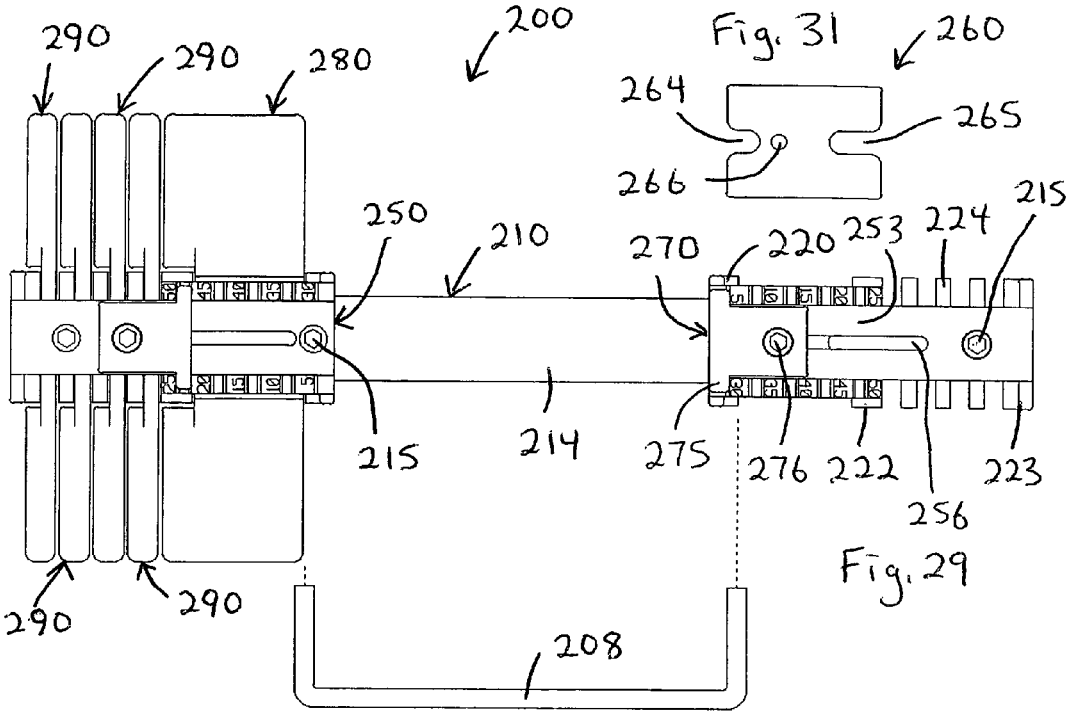
FIG. 29 is a top view of another, partially loaded, exercise dumbbell constructed according to the principles of the present invention.
Figure 30:
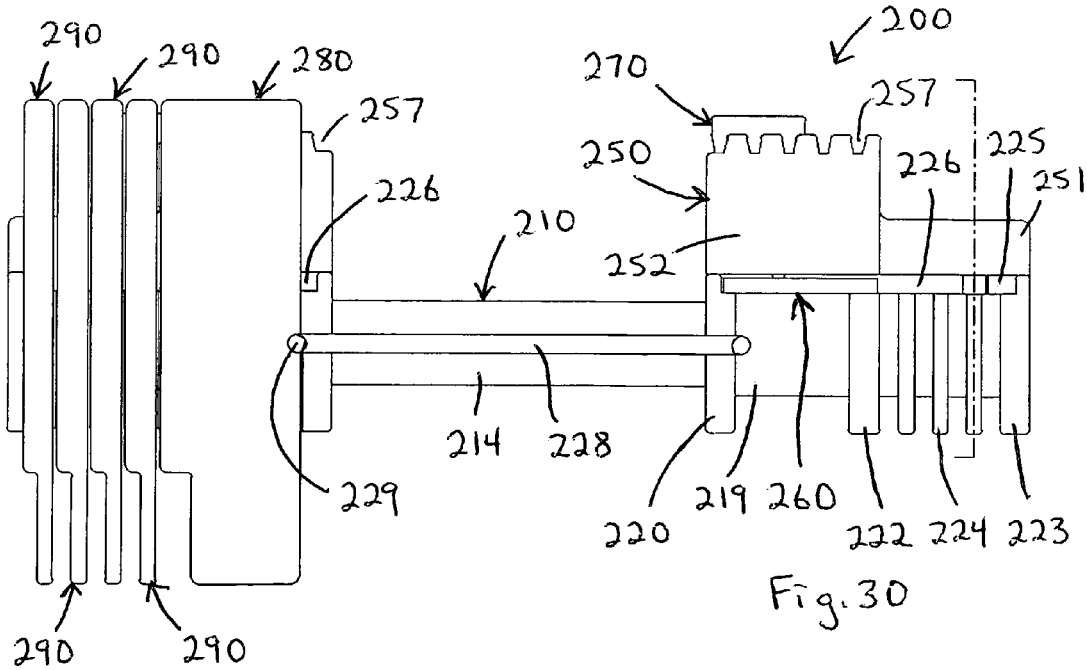
FIG. 30 is a side view of the partially loaded dumbbell of FIG. 29.
Figure 32:
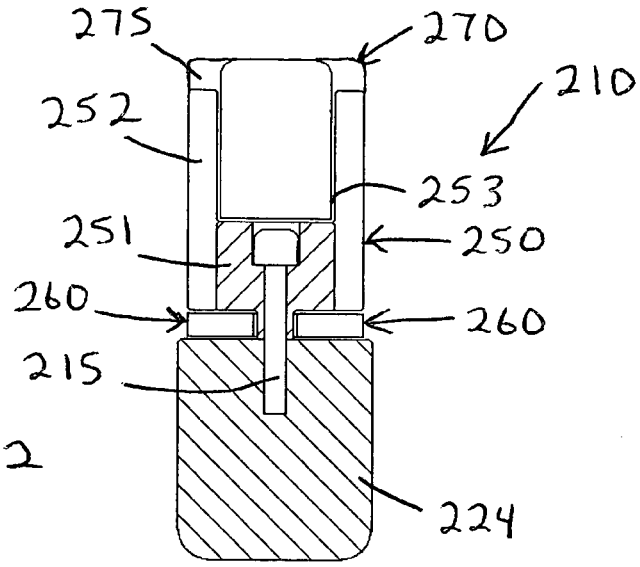
FIG. 32 is a sectioned end view of the unloaded portion of the dumbbell of FIGS. 29-30.

FIGS. 29-30 show another exercise dumbbell constructed according to the principles of the present invention and designated as 200. The dumbbell 200 is similar in some respects to the first dumbbell 100, and is different in other respects. For example, the bar 112, hand grip 114, and weight supports 120, 130, and 140 have been replaced by a single, integrally formed member, which is configured to accommodate four relatively lighter weight plates 290 in addition to one relatively heavier weight plate 280. Also, a distinct type of weight selector 208 or weight selecting means is provided for the weight plates 280.

The integrally formed member includes an intermediate hand grip portion 214, and opposite end portions 219. The hand grip portion 214 may be described as a cylinder having a longitudinal axis. In the alternative, the hand grip 214 may be formed into different shapes and/or provided with surface characteristics to facilitate gripping. An inboard end of each end portion 219 is bounded by a respective flange 220, and an opposite, outboard end of each end portion 219 is bounded by a respective flange 223. These flanges 220 and 223 cooperate with intermediate flanges 222 and 224 to define respective weight gaps or compartments therebetween.

A discrete guide member 250 is rigidly mounted on top of each end portion 219 by means of first and second screws 215 that thread into the end portion 219. Stand-offs are provided on the bottom of each guide member 250 (at each screw 215 location) to define a gap or channel 226 between a majority of the guide member 250 and a majority of the underlying end portion 219. Also, each guide member 250 rests on relatively higher end portions of the end flanges 220 and 223, as well as a shoulder 225 (see FIG. 30) on the end portion 219 just inside the flange 223 and axially aligned with the adjacent stand-off on the guide member 250.

Each guide member 250 includes an outboard section 251 that may be described as relatively low profile, and an inboard section 252 that may be described as relatively high profile. For reasons discussed below, the inboard section 252 defines an axially extending, upwardly opening channel 253, and an axially extending slot 256 extends downward through portions of each section 251 and 252. Also, upwardly opening notches 257 are provided on the top of the inboard section 252, and weight indicia are displayed adjacent to respective notches.

At each end of the dumbbell 200, a weight selector 260 is slidably mounted in a respective channel 226. Each weight selector 260 may be described as a steel plate having a rectangular planform having an axially measured length, and a transversely measured width. A relatively shorter, axially extending notch 264 is formed in an inboard end of the weight selector 260, and a relatively longer, axially extending notch 265 is formed in an opposite, outboard end of the weight selector 260. Each notch 264 and 265 is configured and arranged to avoid interference between the weight selector 260 and respective screws 215 as the weight selector 260 slides axially along a respective end portion 219. For reasons discussed below, a hole 266 extends downward through the weight selector 260 proximate the inboard notch 264.

At each end of the dumbbell 200, a button or operator member 270 is slidably mounted within a respective channel 253 and linked to a respective weight selector 260. In this regard, a hole extends downward through the button 270, and a fastener 276 is inserted through the hole, through the slot 256 in the guide member 250, and into the hole 266 in the weight selector 260. The fastener 276 is rigidly secured to the weight selector 260 by means known in the art, such as threads, welding, snap fit, and/or adhesives. As a preliminary step in the manufacturing process, a helical coil spring is compressed between the head of the fastener 276 and a circumferential lip or shoulder disposed inside the hole in the button 270. As a result of this arrangement, the button 270 is movable along the fastener 276, and is biased downward toward the guide member 250. Tabs 275 project transversely outward from opposite sides of the button 270, and are configured to occupy respective notches 257 in the guide member 250. As a result, the button 270 must be pulled upward before it can be moved axially together with the weight selector 260. In order to ensure that the weight selector 260 remains in axial alignment at all times, it may be desirable to provide both the shaft of the fastener 276 and the hole in the button 270 with a square profile. Alternatively, a second, axially aligned hole may be provided in the weight selector 260, and a pin may be secured within the hole, and arranged to project upward into a somewhat longer version of the slot 256.

Figure 33:
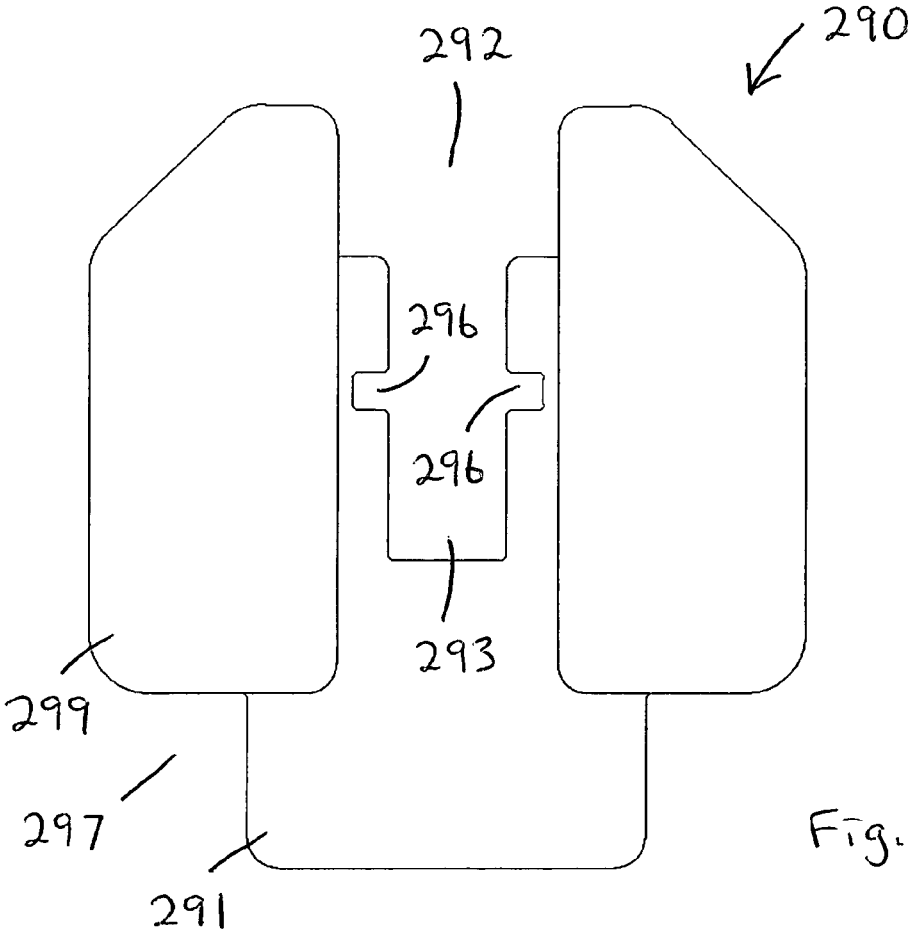
FIG. 33 is an outside end view of a first weight plate on the dumbbell of FIGS. 29-30.

FIG. 33 shows one of the lighter weight plates 290 by itself. Each weight plate 290 is preferably made of steel and configured to weigh two and one-half pounds. The weight plate 290 may be described in terms of a relatively thinner, central portion 291, and relatively thicker shoulders 299 disposed on opposite sides of the central portion 291. Opposite side notches 297 are defined between the lower corners of the central portion 291 and the lower corners of respective shoulders 299. A relatively wide, axially extending slot 292 is defined between the upper portions of the shoulders 299, and a relatively narrower, axially extending slot 293 extends through the central portion 291 and opens upward into the relatively wide slot 292. The slot 292 is configured to accommodate access to and operation of a respective button 270 by a user of the dumbbell 200. The slot 293 is wide enough to receive a relatively narrower portion of a respective end section 219, but not to accommodate the width of the selector member 260.

Opposite side notches 296 extend axially through the central portion 291 and open transversely into the slot 293. The notches 296 cooperate to define a passage that is wide enough to accommodate the width of the selector member 260. As a result, the selector member 260 may be moved axially into the notches 296 in order to secure the weight plate 290 to the handle member 210.

Figure 35:
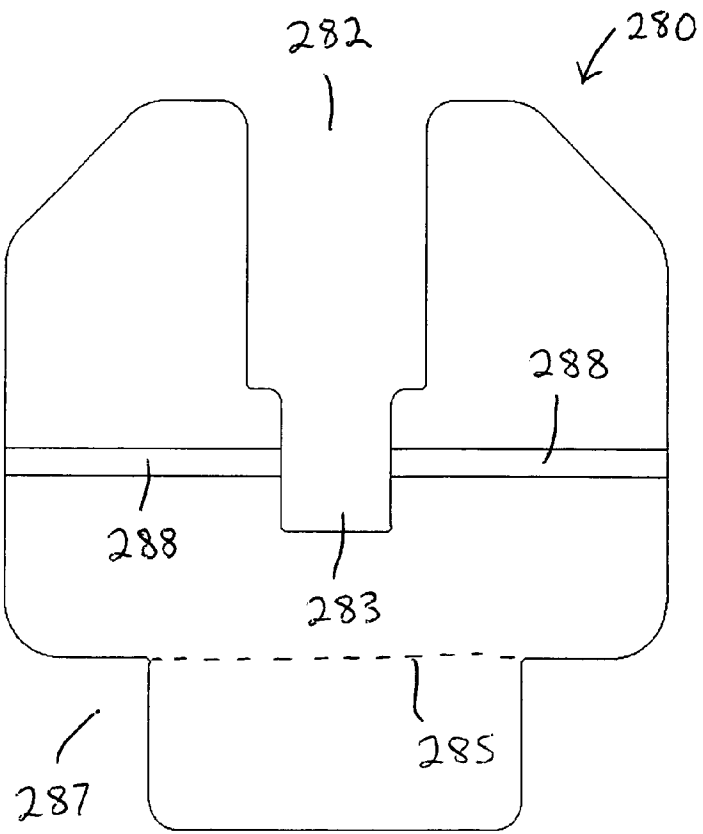
FIG. 35 is an opposite, inside end view of the weight plate of FIG. 34.
Figure 34:
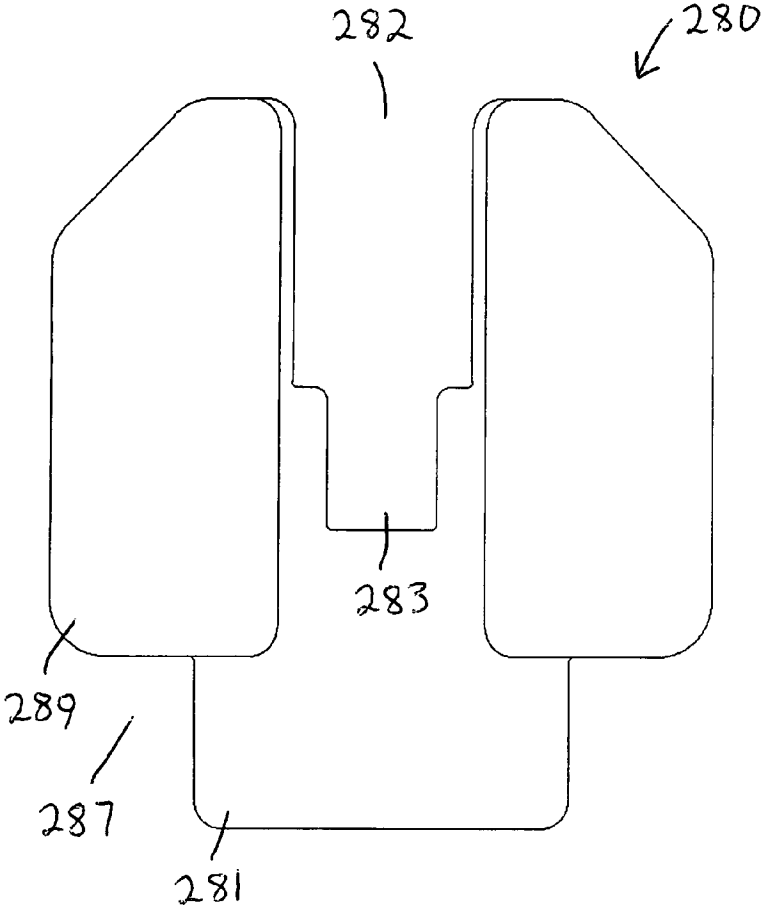
FIG. 34 is an outside end view of a second weight plate on the dumbbell of FIGS. 29-30.

FIGS. 34-35 show one of the heavier weight plates 280 by itself. Each weight plate 280 is preferably made of steel and configured to weigh twelve and one-half pounds. The weight plate 280 may be described in terms of a relatively thinner, central portion 281, and relatively thicker shoulders 289 disposed on opposite sides of the central portion 281. Opposite side notches 287 are defined between the lower corners of the central portion 281 and the lower corners of respective shoulders 289. A relatively wide, axially extending slot 282 is defined between the upper portions of the shoulders 289, and a relatively narrower, axially extending slot 283 extends through the central portion 281 and opens upward into the relatively wide slot 282. As compared to the slot 292 on the lighter weight plate 290, the slot 282 extends further downward into the heavier weight plate 280. In addition to being configured to accommodate access to and operation of a respective button 270 by a user of the dumbbell 200, the slot 282 is configured to accommodate the weight selector 260. In other words, the weight selector 260 can occupy the slot 282, and has no effect on whether or not the heavier weight plate 280 is secured to the handle assembly 210. Like its counterpart on the lighter weight plate 290, the slot 283 is wide enough to receive a relatively narrower portion of a respective end section 219.

FIG. 35 shows the inboard side of the heavier weight plate 280, with a transversely extending groove 288 formed therein. The groove 288 is configured to receive a respective end of a U-shaped weight selector designated as 208 in FIG. 29. A matching hole 229 extends transversely through each end portion 219 to align with a respective groove 288 and similarly receive a respective end of the weight selector 208. Also, an axially extending groove 228 is provided in the near side of the hand grip portion 214 to receive an intermediate portion of the weight selector 208. In other words, the intermediate portion of the weight selector 208 is movable to a nested position inside the hand grip portion 214, and remains in place so long as a user of the dumbbell 200 maintains a grip on the hand grip portion 214. In the alternative, the heavier weights 280 may be engaged by other sorts of weight selectors or connecting means, some of which are disclosed in the patents incorporated herein by reference.

Figure 36:
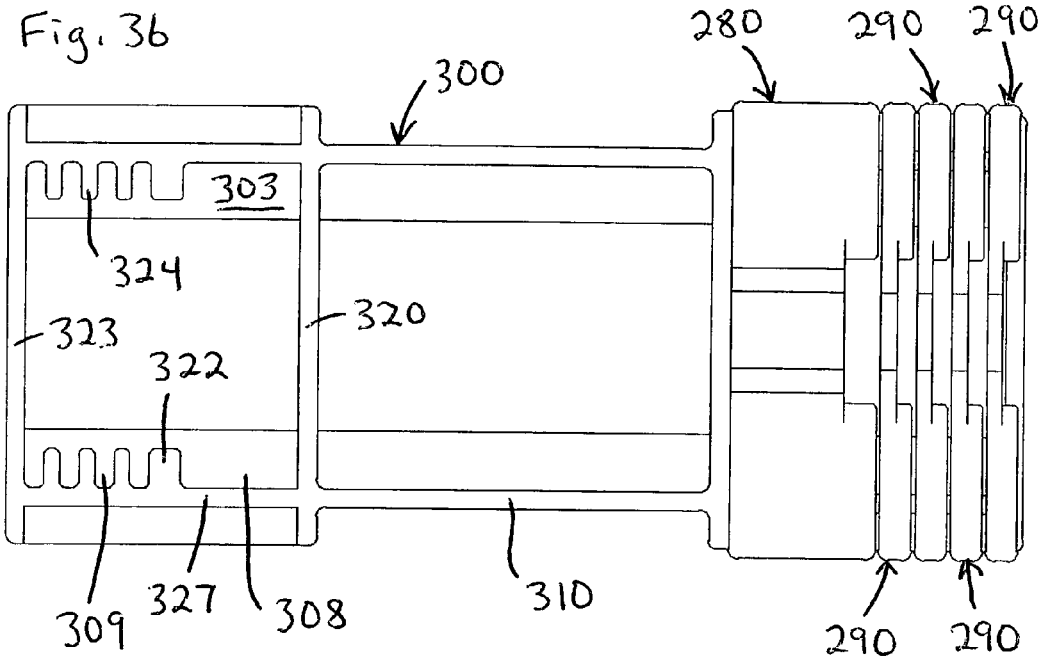
FIG. 36 is a top view of a partially loaded weight cradle configured to support weight plates for use with the dumbbell of FIGS. 29-30.
Figure 37:
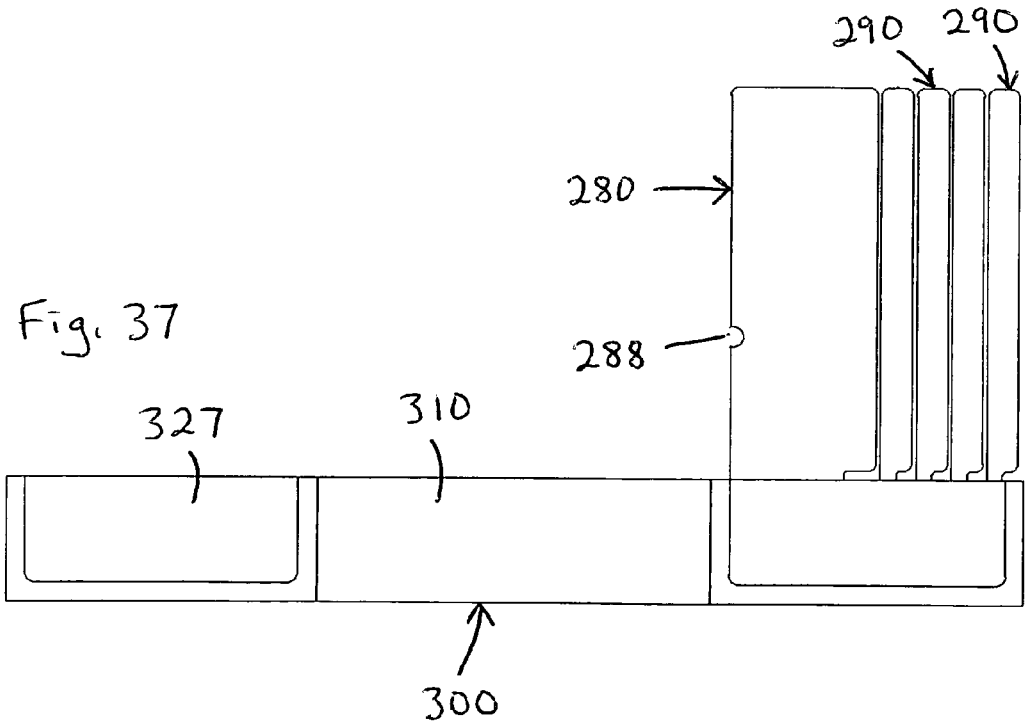
FIG. 37 is a side view of the partially loaded weight cradle of FIG. 31.

FIGS. 36-37 show one set of the weight plates 280 and 290 supported by a base or cradle 300. As noted above, a modified version of this same type of cradle 300 may be used to similarly support the weight plates 180 and 190 associated with the first dumbbell 100.

The cradle 300 includes first and second end portions that are configured to support respective weight plates 280 and 290, and an intermediate portion that maintains a fixed distance between the end portions. Each end portion includes an inboard wall 320, an outboard wall 323, and opposite side walls 327 extending therebetween. Flanges 322 and 324 protrude from the side walls 327 and are configured to align with respective flanges 222 and 224 on the handle member 210. As a result, the cradle 300 defines slots or compartments 308 and 309 that are configured to maintain respective weight plates 280 and 290 in the same axially spaced arrangement as the handle member 210. As on the handle member 210, the compartments 308 and 309 are configured to receive the relatively thinner, central portions 281 and 291 of respective weight plates 280 and 290. Bottom walls 303 extend between the outboard walls 323 and underlie the flanges 322 and 324. Each intermediate portion includes opposite side walls 310 that may be described as extensions of respective side walls 327. The end portions are also shown with outwardly extending structure or feet that enhance the stability and structural integrity of the cradle 300.

When both weight plates 280 are resting on the cradle 300, the weight selector 208 may be inserted partially into the opposing grooves 288 for storage purposes. As suggested by the dashed line 285 in FIG. 35, the grooves 288 may be enlarged to allow the weight selector 208 to drop downward onto the cradle 300 when not in use, and the cradle 300 may be modified to provide even more stable support for the lowered weight selector 208.

Like the first dumbbell 100, the dumbbell 200 provides a relatively wide range of available dumbbell weights in a relatively compact and easy to use arrangement. With the handle member 210 made to weigh five pounds, the dumbbell 200 may weigh as little as five pounds and as much as fifty pounds, and it may be adjusted in balanced increments of five pounds and out of balance increments of two and one-half pounds. Each two and one-half pound adjustment is made by sliding a button 270 and associated weight selector 260 outward one increment or notch 257 in order to engage one additional lighter weight plate 290. A twenty-five pound adjustment is made by inserting the selector member 208 into the grooves 288 and through the handle member 210 in order to engage the heavier weight plates 280. Weight indicia on one side of the guide member 250 show the available increments (including the currently selected weight) when the heavier weight plates 280 are disengaged, and weight indicia on the other side of the guide member 250 show the available increments (including the currently selected weight) when the heavier weight plates 280 are engaged.

The present invention may also be described in terms of various methods of adjusting resistance to exercise, with reference to one or more of the embodiments disclosed herein, for example. One such method involves adjusting weight on a selectorized dumbbell, and comprises the steps of providing a handle member having a handle that defines a longitudinal axis, first and second weight supporting sections at opposite ends of the handle, first and second bars that extend through respective weight supporting sections, and weight selectors that are movable axially along respective weight supporting sections; and providing first end weights and second end weights that are configured to be supported in respective, axially spaced positions defined by the respective weight supporting sections, and to be selectively engaged by respective weight selectors, and that have slots to accommodate insertion of respective bars and to provide operational access to respective weight selectors.

The present invention has been described with reference to specific embodiments and particular applications. However, this disclosure will enable those skilled in the art to derive additional embodiments and/or applications. For example, some of the disclosed selection apparatus and/or methods may be applicable to weight machines, as well as free weights. Moreover, features of the disclosed embodiments and/or methods may be mixed and matched in numerous ways (with one another and/or with the prior art incorporated herein by reference) to arrive at additional variations of the present invention. In view of the foregoing, the scope of the present invention is to be limited only to the extent of the following claims.

What is claimed is:

1. A method of adjusting weight on a selectorized dumbbell, comprising the steps of:

providing a handle assembly having a handle that defines a longitudinal axis, a first weight supporting section at a first end of the handle, a second weight supporting section at an opposite, second end of the handle, a first weight selector that is movable along the first weight supporting section, and a second weight selector that is movable along the second weight supporting section;

providing a first weight and a second weight to occupy respective positions defined by the first weight supporting section, wherein the first weight defines an upwardly closed opening configured and arranged to accommodate the first weight selector, and the second weight defines an upwardly open notch configured and arranged to accommodate the first weight selector;

selectively moving the first weight selector between a first latched position, spanning only the first weight and thereby preventing upward movement of the handle assembly relative to the first weight, and a second latched position, spanning only the second weight and thereby freeing the handle assembly for upward movement relative to both the first weight and the second weight;

providing a third weight and a fourth weight to occupy respective positions defined by the second weight supporting section, wherein the third weight defines an upwardly closed opening configured and arranged to accommodate the second weight selector, and the fourth weight defines an upwardly open notch configured and arranged to accommodate the second weight selector; and selectively moving the second weight selector between a first latched position, spanning only the third weight and thereby preventing upward movement of the handle assembly relative to the third weight, and a second latched position, spanning only the fourth weight and thereby freeing the handle assembly for upward movement relative to both the third weight and the fourth weight.

2. The method of claim 1, further comprising the step of using a separate selecting means to selectively secure the second weight and the fourth weight to the handle assembly.

3. The method of claim 2, wherein each said weight selector is movable parallel to the axis between a respective said first latched position and a respective said second latched position, and the separate selecting means includes at least a third weight selector that is moved perpendicular to the axis to selectively underlie at least one of the second weight and the fourth weight.

4. The method of claim 2, wherein each said weight selector is movable parallel to the axis between a respective said first latched position and a respective said second latched position, and the separate selecting means includes at least a third weight selector that is also moved parallel to the axis to selectively underlie at least one of the second weight and the fourth weight.

5. The method of claim 2, wherein the separate selecting means includes (a) a third weight selector that is selectively moved between a first latched position, occupying an upwardly closed opening in the second weight and thereby preventing upward movement of the handle assembly relative to the second weight, and a second latched position, outside the upwardly closed opening in the second weight and occupying an upwardly open notch in the first weight, thereby freeing the handle assembly for upward movement relative to both the first weight and the second weight; and (b) a fourth weight selector that is selectively moved between a first latched position, occupying an upwardly closed opening in the fourth weight and thereby preventing upward movement of the handle assembly relative to the fourth weight, and a second latched position, outside the upwardly closed opening in the fourth weight and occupying an upwardly open notch in the third weight, thereby freeing the handle assembly for upward movement relative to both the third weight and the fourth weight.

6. A method of adjusting weight resistance to exercise movement, comprising the steps of:

providing a weight lifting member having a weight supporting section, and a weight selector that is movable along the weight supporting section;

providing a first weight and a second weight to occupy respective positions defined by the weight supporting section, wherein the first weight defines an upwardly closed opening configured and arranged to accommodate the weight selector, and the second weight defines an upwardly open notch configured and arranged to accommodate the weight selector; and selectively moving the weight selector between a first latched position, spanning only the first weight and thereby preventing upward movement of the weight lifting member relative to the first weight, and a second latched position, spanning only the second weight and thereby freeing the weight lifting member for upward movement relative to both the first weight and the second weight.

7. The method of claim 6, further comprising the steps of providing a second weight selector on the weight lifting member for moving along the weight supporting section between a first latched position, occupying an upwardly closed opening in the second weight and thereby preventing upward movement of the weight lifting member relative to the second weight, and a second latched position, outside the upwardly closed opening in the second weight and occupying an upwardly open notch in the first weight, thereby freeing the weight lifting member for upward movement relative to both the first weight and the second weight.

8. The method of claim 7, further comprising the step of providing indicia on each said weight selector to cooperatively indicate how much the weight lifting member weighs as a function of the latched position of each said weight selector.

9. A method of adjusting weight resistance to exercise movement, comprising the steps of:

providing a weight lifting member having a weight supporting section, a first weight selector that is movable in a first direction relative to the weight supporting section, and a second weight selector that is movable in a second direction relative to the weight supporting section, wherein the second direction is perpendicular to the first direction;

providing a first weight and a second weight to occupy respective positions defined by the weight supporting section, wherein the first weight defines an upwardly closed opening configured and arranged to accommodate the first weight selector, and the second weight defines both an upwardly closed opening configured and arranged to accommodate the second weight selector, and an upwardly opening notch configured and arranged to accommodate the first weight selector;

selectively moving the first weight selector between a first position, occupying the opening in the first weight to prevent upward movement of the weight lifting member relative to the first weight, and a second position, occupying the notch in the second weight to free the weight lifting member for upward movement relative to the first weight; and selectively moving the second weight selector into the opening in the second weight to prevent upward movement of the weight lifting member relative to the second weight.

10. A method of adjusting weight resistance to exercise movement, comprising the steps of:

providing a weight lifting member with (a) a handle that defines a longitudinal axis, and (b) a respective weight supporting section at each end of the handle, and (c) a respective first weight selector for each said weight supporting section, wherein each said first weight selector is movable in a first direction relative to a respective said weight supporting section, and (d) a second weight selector that is (i) movable in a second direction, perpendicular to the first direction, and (ii) configured to span the handle;

providing a respective first weight for each said weight supporting section, and a respective second weight for each said weight supporting section, wherein each said weight occupies a respective position in a respective said weight supporting section, and each said first, weight defines an upwardly cloned opening configured and arranged to accommodate a respective said first weight selector, and each said second weight defines an upwardly closed opening configured and arranged to accommodate the second weight selector;

selectively moving each said first weight selector into the opening in a respective said first weight to prevent upward movement of the weight lifting member relative to each said first weight; and selectively moving the second weight selector into the opening in each said second weight to prevent upward movement of the weight lifting member relative to each said second weight.

11. The method of claim 10, further comprising the step of grasping in one's hand an intermediate portion of the second weight selector together with the handle.

* * * * *